US007798358B2

(12) United States Patent
Butler et al.

(10) Patent No.: US 7,798,358 B2
(45) Date of Patent: Sep. 21, 2010

(54) WASTE DISPOSAL RECEPTACLE

(75) Inventors: Raymond Thomas Butler, Auckland (NZ); Patricia Margaret Butler, Auckland (NZ); Paul Francis Zwaan, Auckland (NZ); Michael Freeman, Auckland (NZ)

(73) Assignee: Fumacare Limited, Waitakere (NZ)

( * ) Notice: Subject to any disclaimer, the term of this patent is extended or adjusted under 35 U.S.C. 154(b) by 162 days.

(21) Appl. No.: 11/597,788

(22) PCT Filed: May 30, 2005

(86) PCT No.: PCT/NZ2005/000107

§ 371 (c)(1),
(2), (4) Date: Jul. 27, 2007

(87) PCT Pub. No.: WO2005/115882

PCT Pub. Date: Dec. 8, 2005

(65) Prior Publication Data

US 2008/0087668 A1 Apr. 17, 2008

(30) Foreign Application Priority Data

May 28, 2004 (NZ) ..... 533197

(51) Int. Cl.
*B65D 6/40* (2006.01)
*B65D 43/20* (2006.01)
*B65D 43/22* (2006.01)

(52) U.S. Cl. ..... 220/345.1; 220/8; 220/345.4; 220/480; 220/908.2

(58) Field of Classification Search ..... 220/345.1, 220/576, 8, 480, 483, 252, 345.4, 253, 522, 220/908.2
See application file for complete search history.

(56) References Cited

U.S. PATENT DOCUMENTS 575,621 A * 1/1897 Smith ..... 220/8

(Continued)

FOREIGN PATENT DOCUMENTS

DE 10108884 A1 9/2002

(Continued)

OTHER PUBLICATIONS

International Search Report dated Jul. 21, 2005 issued in PCT/NZ2005/000107.

(Continued)

*Primary Examiner*—Anthony Stashick
*Assistant Examiner*—Niki M Eloshway
(74) *Attorney, Agent, or Firm*—Venable LLP; Zayd Alathari

(57) ABSTRACT

A waste disposal receptacle (1) including a body (20) and a lid (30). Wherein the body (20) is defined by a base (21), at least one side (22) and an open top (23); and the lid (30) is defined by at least one side (31), a top (32) and an open base and includes an aperture (35) in the at least one side (31) through which material can be deposited into the receptacle (1); Wherein the at least one side (31) of the lid (30) is adapted to be received within the body (20) and is reversibly movable between an open and closed position such that when the lid (30) is in the closed position, the aperture (35) is covered by the at least one side (22) of the body (20) and when the lid (30) is in the open position, the aperture (35) is exposed.

21 Claims, 6 Drawing Sheets

U.S. PATENT DOCUMENTS

| | | | | | |
|---|---|---|---|---|---|
| 1,023,276 | A | * | 4/1912 | Rouse | 206/1.5 |
| 1,506,273 | A | * | 8/1924 | Smith | 220/8 |
| 2,214,437 | A | * | 9/1940 | Punte et al. | 206/536 |
| 2,367,019 | A | * | 1/1945 | Haag | 206/539 |
| 2,759,625 | A | | 8/1956 | Ritter | |
| 2,763,395 | A | * | 9/1956 | Meek | 220/8 |
| 3,105,592 | A | * | 10/1963 | Cohen | 206/8 |
| 3,286,717 | A | * | 11/1966 | Teegardin | 453/58 |
| 3,286,872 | A | * | 11/1966 | Burdick, Jr. | 220/351 |
| 3,762,539 | A | * | 10/1973 | Kerr | 206/537 |
| 3,791,514 | A | * | 2/1974 | Watanabe | 204/407 |
| 4,234,093 | A | * | 11/1980 | Tyson | 206/536 |
| 4,261,461 | A | * | 4/1981 | Kizlauskas | 206/765 |
| 4,353,379 | A | * | 10/1982 | Castellanos | 131/231 |
| 4,544,063 | A | * | 10/1985 | Neward | 206/540 |
| 4,618,444 | A | * | 10/1986 | Hudson et al. | 8/111 |
| 5,082,132 | A | | 1/1992 | Tsai | |
| 5,213,294 | A | * | 5/1993 | DeBord | 248/147 |
| 5,620,109 | A | * | 4/1997 | Madden | 220/345.4 |
| 5,651,231 | A | * | 7/1997 | Garland | 53/258 |
| 5,755,020 | A | * | 5/1998 | Panyon, Jr. | 29/434 |
| 5,915,560 | A | * | 6/1999 | George et al. | 206/537 |
| 6,267,461 | B1 | * | 7/2001 | Dunagan et al. | 312/49 |
| 6,364,147 | B1 | | 4/2002 | Meinzinger et al. | |
| D495,250 | S | * | 8/2004 | Learey | D9/428 |
| 2004/0026420 | A1 | * | 2/2004 | Smith | 220/253 |
| 2006/0138134 | A1 | * | 6/2006 | Martin | 220/253 |

FOREIGN PATENT DOCUMENTS

| | | | |
|---|---|---|---|
| EP | 0 853 051 | A1 | 7/1998 |
| EP | 1 500 613 | A1 | 1/2005 |
| GB | 2 165 530 | A | 4/1986 |
| JP | 08-157004 | A | 6/1996 |

OTHER PUBLICATIONS

European Search Report, dated Feb. 12, 2009 issued in EP 05747520.4-1261.

Statement of Verification by New Zealand Translation Centre Ltd., of accurate translation of German EP 0 853 051 A1, Dated May 29, 2009, and translated document.

* cited by examiner

WASTE DISPOSAL RECEPTACLE

The present invention relates to a receptacle. In particular, the invention relates to a receptacle for the disposal of rubbish or sanitary waste.

BACKGROUND OF THE INVENTION

Many types of waste disposal receptacles are available, particularly receptacles that are designed for the disposal of women's sanitary products. Such bins are not generally emptied on site, but are taken away and replaced with a fresh bin, due to the hazardous nature of the waste.

Sanitary bins are usually accessed via a flap which allows waste material to be placed into the receptacle. This requires that the user handles the bin around the area of access to the bin to expose the flap. This can also accumulate waste material in an area around the access to the receptacle which can be unsightly, and potentially a health hazard.

Other types of receptacles are also available for disposal of food scraps and other such waste. Similar issues arise with these products as with sanitary bins, as food and other waste material can build up around the access area causing health issues for example.

It is an object of the invention to provide a receptacle which overcomes or at least reduces some of the disadvantages of presently available receptacles or which at least provides the public with the useful alternative.

Other objects of the invention may become apparent from the following description, which is given by way of example only.

SUMMARY OF THE INVENTION

According to one aspect of this invention there is provided a receptacle which includes a body and a lid;

wherein the body is defined by a base, at least one side and an open top; and the lid is defined by at least one side, a top and an open base and includes an aperture in the side through which material can be deposited into the receptacle;

wherein the at least one side of the lid is adapted to be received within the at least one side of the body and is reversibly movable between an open and closed position such that when the lid is in the closed position the aperture is covered by a body side and when the lid is in the open position, the aperture is exposed.

Preferably the body and lid are cylindrical and the lid is set least partially rotatable within the body.

Preferably the interaction between the lid and the body forms a substantially airtight seal.

Preferably the receptacle includes an opening means to assist a user in moving the lid from the closed to the open position.

Preferably the body and lid have more than one side, the lid sides being reciprocally movable in relation to the body sides.

Preferably the opening means is a handle attached to the lid.

Preferably the body includes a retention mechanism which prevents the lid from being readily removed from within the body.

Preferably the lid includes a lip which prevents the top of the lid from moving past the open top of the body.

Preferably the body further includes an external support flange.

Preferably the base of the body includes a domed or flat external surface.

Preferably the flat external surface is adapted to support the receptacle in a free standing manner.

Preferably the lid includes fastening means attached to the inside of the lid wall, the fastening means being adapted to allow attachment of freshness products inside the receptacle.

Preferably the lid includes a lip situated above the aperture, the lip being adapted, when the receptacle is in the closed position, to abut the top of the body wall and to allow the aperture to be covered by the body wall.

Preferably the lip is circumferential about the lid side.

Preferably the lip is not circumferential but extends sufficiently about the lid side to extend at least the length of the aperture.

According to another aspect, the invention provides a receptacle as described in the first aspect of the invention together with a support means, wherein the receptacle further includes an external support flange, and the support means is adapted to interact with the external support flange to removably attach the receptacle to the support means.

Preferably the support means is also attachable to a mounting surface.

Preferably the mounting surface is a wall.

Preferably the support means is a pedestal.

BRIEF DESCRIPTION OF THE FIGURES

This invention may be better understood with reference to the following Figures which illustrate preferred embodiments, in which:

FIG. 5 shows the preferred embodiment of FIG. 1 in the closed position during one form of transport.

FIG. 6 shows a preferred form of the invention together with an alternative support means.

DETAILED DESCRIPTION OF THE FIGURES

The invention, in broad terms, provides a receptacle for containing waste material. The receptacle may be especially suitable for use in rest rooms for the disposal of sanitary waste. The receptacle may also be used for the disposal of other types of rubbish including food scraps or other perishable wastes. The receptacle is adapted to be able to receive waste material with a reduced amount of contact between the user and the access to the receptacle, and is also adapted to be removed as a complete unit for later disposal of the waste material contained therein.

Figure 1:
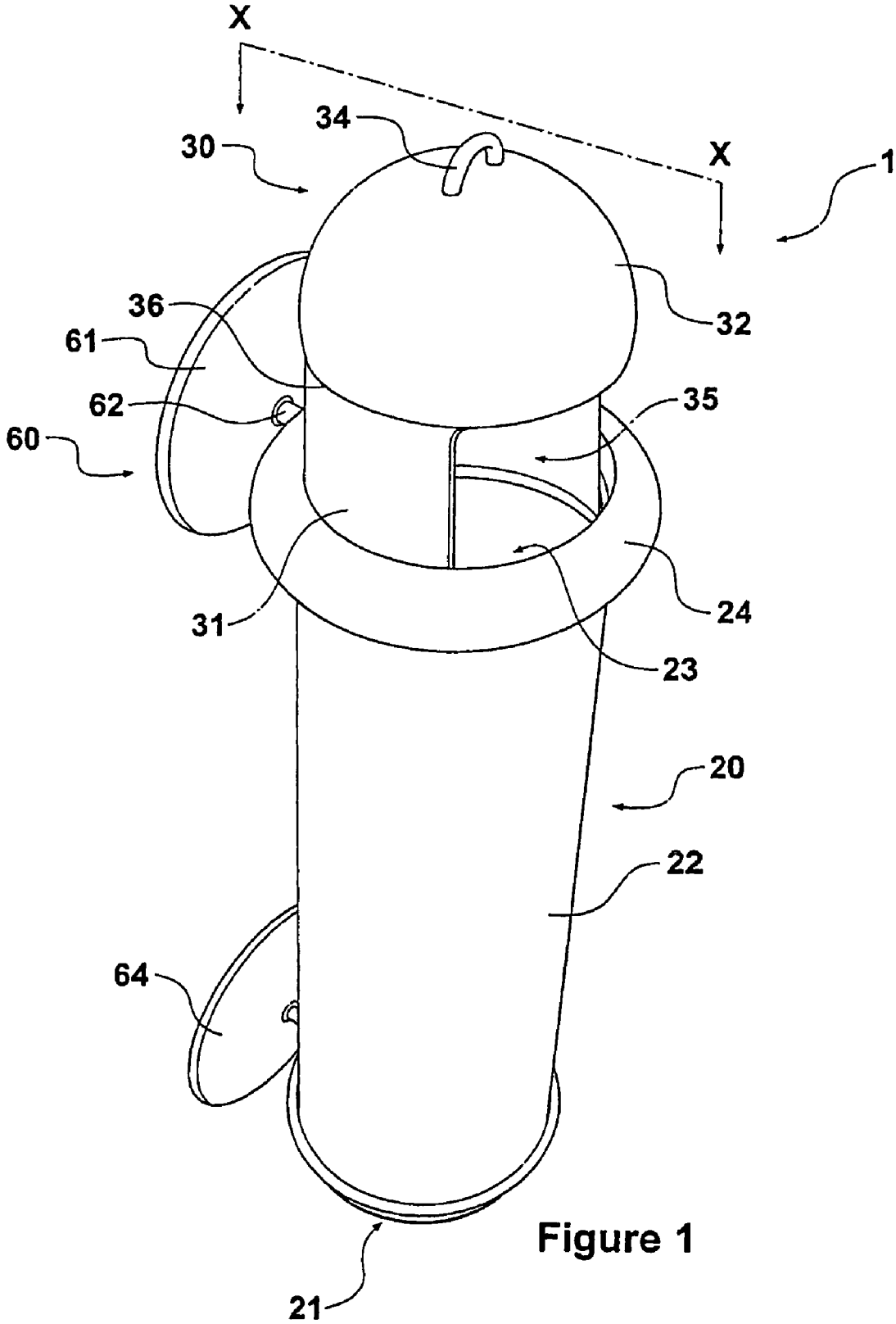
FIG. 1: shows a preferred embodiment of the invention in the open position with a first supporting means option.
Figure 2:
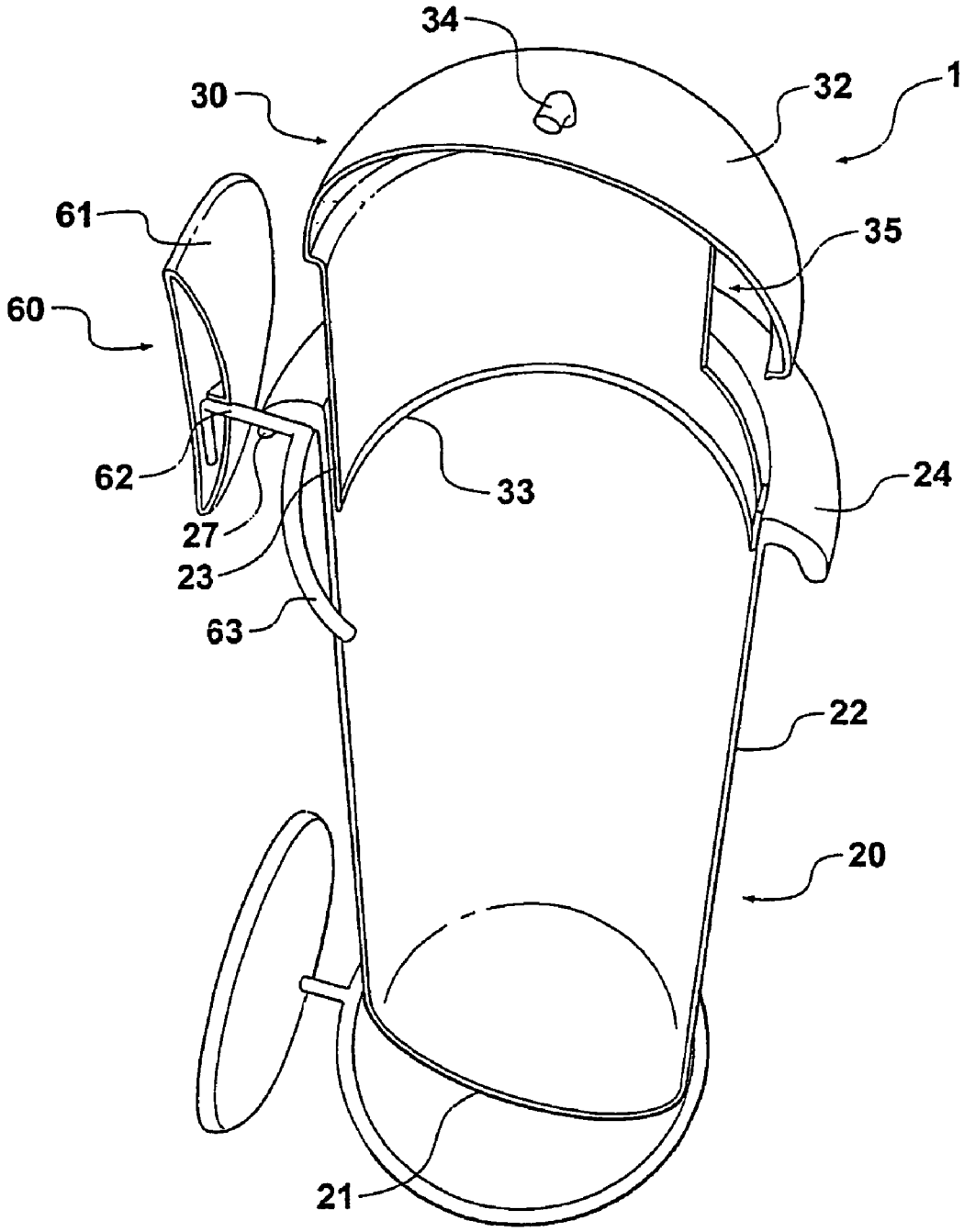
FIG. 2: shows a cross section through the axis X-X of the embodiment shown in FIG. 1.

A preferred embodiment of the invention is shown in FIGS. 1 and 2. A receptacle 1 is made up of a body 20 and a lid 30.

The body 20 is defined by a base 21 and at least one side 22. The body as shown in these Figures is cylindrical in shape thus including one continuous side. The base 21 is convex in shape when viewed from the outside of the receptacle 1. The body 20 has an open top 23 (best seen in FIG. 2).

The lid 30 is defined by at least one side 31 (again cylindrical as shown in the Figures) and a top 32. The lid has an open base 33 (best seen in FIG. 2). The lid 30 includes an aperture 35 located in the side 31. The lid side 31 is adapted to fit snugly within and adjacent the body side 23 while allowing movement of the lid 30 relative to the body 20 between an open and closed position. The interaction between the lid 30 and the body 20 is telescopic in nature with the lid 30 being reciprocally movable as a whole in relation to the body 20. The body side 22 and the lid side 31 lie adjacent each other in a manner that allows telescopic movement (or reciprocal movement) of the lid 30 relative to the body 20. FIGS. 1 and 2 shows the lid 30 in the open position.

When the lid 30 is in the open position (as seen in FIGS. 1 and 2), waste material can be deposited into the receptacle 1 through aperture 35. The waste material (not shown) is placed into the receptacle 1 via aperture 35 and falls through the open base 33 of the lid 30 and into the body 20 coming to rest at/or adjacent to the closed base 21 of the body 20.

As the lid 30 is movable within body 20, any waste material that may adhere or otherwise become attached around, or to, the aperture 35 is held within the body 20. This is important from a visual and hygiene aspect. Visually, it is unattractive to see waste material on the outside of the receptacle. Hygienically, the presence of such waste material is a problem as users could come into contact with that waste material, with consequent health risks. If the lid 30 plus aperture 35 was held outside body 20, then the unattractive visual and unhygienic aspects can readily occur.

The lid 30 includes a handle 34 at its apex. This handle 34 assists the user to move the lid 30 to an open position from a closed position. As will be readily apparent, the handle 34 may be substituted by a variety of types of opening means which extend from the lid, such as loops, toggles or other such means. Preferably the handle 34 (or other forms of opening means) will be positioned away from the aperture 35 to minimise contact with the aperture by the operator when exposing the aperture 35. This allows for hygienic disposable of waste material without the operator coming into contact with any residual waste material which may have been left on the edges of or about the aperture by previous users. It also provides less surfaces which may be subject to soiling by waste material when waste is deposited.

The handle 34 may be adapted to include a removable cover (not shown) for protection to impact or wear and tear during transport. The cover would preferably be snap-on to eliminate the need for fasteners or adhesives that would need replacing. The handle 34 may also be a variety of other shapes as will be appreciated by the skilled person.

Alternatively the handle 34 could be replaced by a hands-free design, such as a foot pedal, or sensor operated touch-free system that would allow the user to move the lid to the open position without needing to contact the lid in any way. These options may be incorporated into the invention in a manner that would be well understood by persons skilled in the art.

As would be apparent to the skilled person there may be a benefit in maintaining a substantially airtight seal (not shown) between the lid side 31 and the body side 22. This substantial airtight seal, formed by interaction between the lid side 31 and the body side 22, would allow movement, but minimise the air flow, between the lid side 31 and body side 22. The substantially airtight seal may be formed by any suitable seal type such as frictional, or of a brushing or gasket type, as would be appreciated by persons skilled in the art.

Both the body 20 and lid 30 may be multi-sided (e.g. square, pentagonal, etc.) as would be appreciated by a skilled person. However, as seen in the Figures, it is preferable that the base 20 and lid 30 together form a substantially cylindrical shape having one continuous side in each, and the base 21 is substantially convex when viewed from the outside of the receptacle 1. When there is more than one side, i.e. the shape of the receptacle is triangular, square etc., the lid and body will have the same number of sides and the lid will move telescopically within the body, the walls of the lid being able to move in a reciprocal manner past the walls of the body.

The cylindrical shape of the lid 30 and body 20 and the convex shape of the base 21 is a preferred configuration because there are no corners or recesses and it allows easy alignment when placing the receptacle within the support means. The telescopic nature of the relationship between the lid 30 and the body 20 also minimises the existence of corners or recesses that occur with hinged lid systems and like options. This allows easier cleaning of the inside of the receptacle, and quicker more thorough and therefore more hygienic drying. With sanitary bins particularly such hygiene issues are extremely important.

Preferably the body 20 is of a generally elongate shape. This allows a more ergonomic access to the receptacle 1 from either a standing or seated position. The length and cylindrical shape of the body 20 also allows for greater compaction of the waste material contents of the receptacle 1 under its own weight. There are also a number of other advantages arising from the elongate shape, including a reduced visibility of the bottom portion of the receptacle and its contents, better utilisation of space.

As would be appreciated, the length of the receptacle 1 could be adjusted as would be known by people skilled in the art, to accommodate varying environments for the receptacle to be used in, different applications of the receptacle and variations in servicing of the receptacle 1 including frequency of servicing. While preferred, the elongate shape is not essential.

The receptacle 1 as shown in FIGS. 1 and 2 the body 20 includes an external support flange 24. The flange 24 preferably extends from the sides 22 of the body 20, and is positioned adjacent to the open top 23. As best seen in FIG. 2, the flange 24 includes a concave shape to the underside 26 of the flange 24. The flange 24 encircles the body 20 of receptacle 1. As will be appreciated the flange 24 need not be continuous and need not completely encircle the receptacle 1.

The flange 24 is also adapted to interact with a support means 60 to allow secure stowage of the receptacle. One option for a support means 60, a wall mounted support means, is shown in FIGS. 1 and 2. In this option, the support means 60 includes at least one wall mounted base 61 attachable to a wall or other surface (not shown). A projection 62 extends from wall-mounted base 61. A rail 63 (best seen in FIG. 2) is connected to the projection 62 and is adapted to releasably support the receptacle 1. The receptacle 1 fits inside the rail 63 and the rail 63 abuts the concave side 26 of the external support flange 24 thus holding receptacle 1 in position. As an additional option, the flange 24 could further be adapted to include a snap on protecting ring that could be used to reduce the effect of impacts or other damaging actions that can occur on transport of the receptacle.

The receptacle 1 is easily removed from the support means 60 by lifting and can be simply swapped for a clean receptacle. The preferred elevated mounting of the receptacle 1 on the wall also provides more ergonomic access for the user from either a standing or seated position. It also creates an uncluttered and pleasing usual effect of the receptacle floating in space above the floor. The height of the supporting means 60 on the wall or other appropriate surface can be positioned to suit the installation requirements of the receptacle 1.

Figure 5:
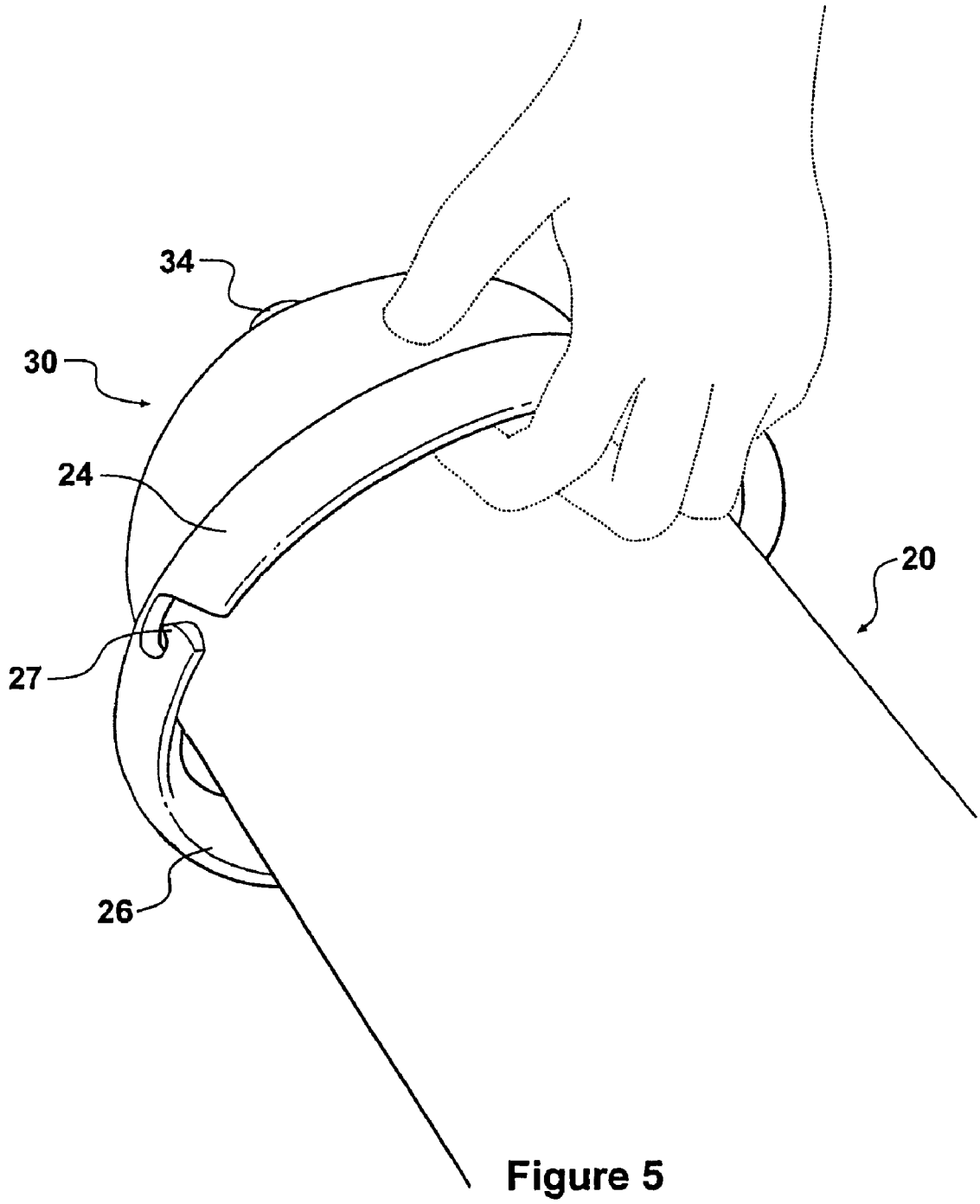
FIG. 5.

The flange 24 also preferably includes a locking mechanism 27 (best shown in FIG. 2) which interacts with the projection 62 to hold the receptacle 1 securely in place on the support means 60. The locking mechanism 27 may simply be a slot or groove in the flange 24 that fits releasably around the projection 62 thus preventing movement of the receptacle 1 around the rail 63. A preferred embodiment of the locking mechanism 27 is best seen in FIG. 5. The locking mechanism 27 could also include a device to prevent the receptacle from being lifted off the support means 60 if needed. Such devices would be known to a skilled person.

While the flange 24 is represented in the Figures as being substantially circumferential, it is to be appreciated that the flange 24 need not extend around the full circumference and may include two or more spaced apart flanges, for example.

As seen in FIGS. 1 and 2, there may also be more than one support means 60 used. The second support means 64 is adapted to hold the receptacle 1 in place to prevent undue movement.

Figure 3:
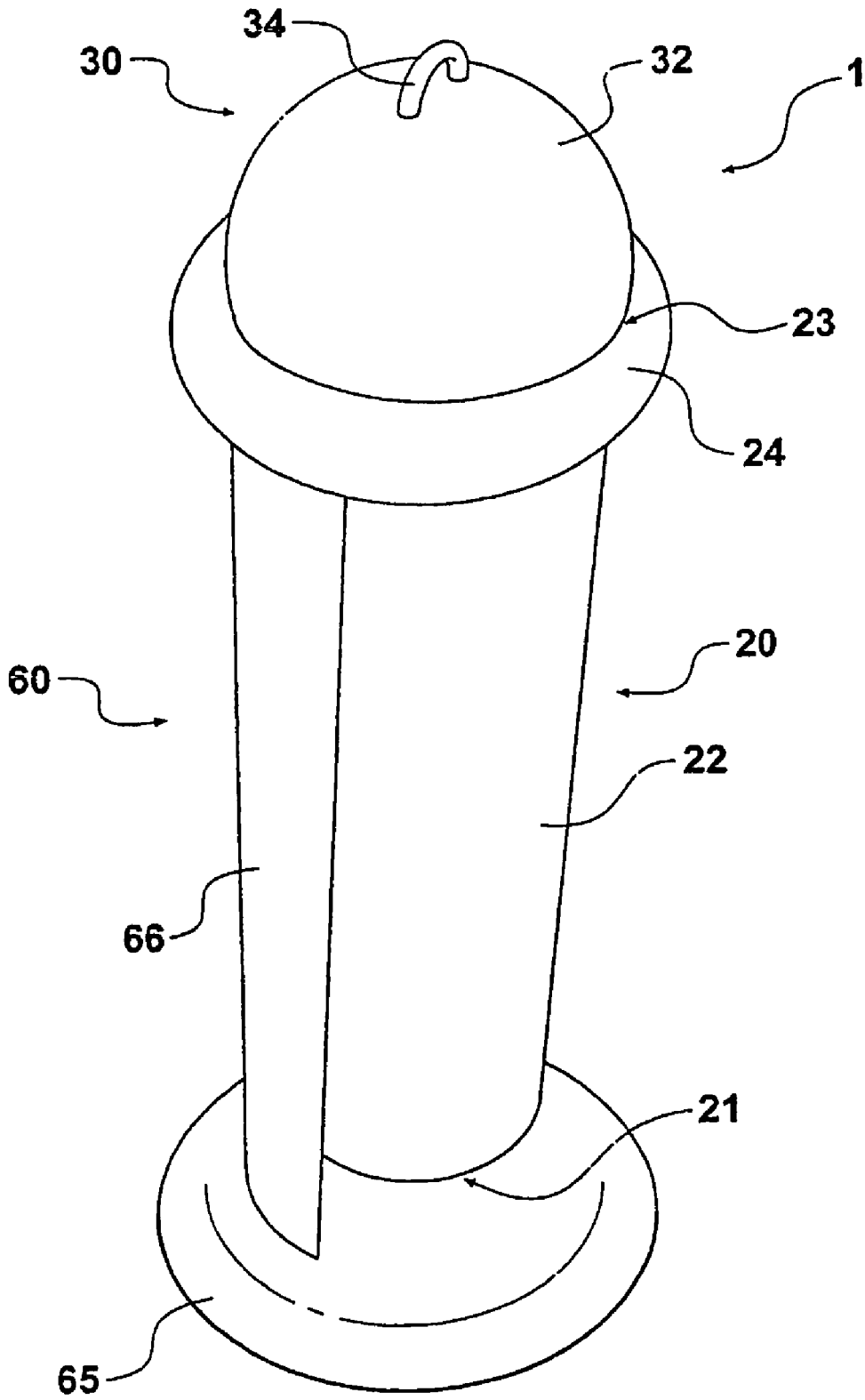
FIG. 3: shows the preferred embodiment of FIG. 1 in the closed position with a second supporting means option.

In FIG. 3 the receptacle 1 is shown with the lid 30 in the closed position. In this position, the sides 31 (obscured in FIG. 3) of the lid 30 are positioned below the open top 23 of the body 20. The aperture 35 is therefore also below the open top 23 of body 20 and lies adjacent to the sides 22 of the body. As a result aperture 35 is inaccessible and not visible from the outside of the receptacle. This visual effect is important as it maintains the clean lines of the receptacle as a whole. In addition, as discussed earlier, the aperture 35 is within the body 20, any waste material that may be visible about the aperture 20 is held within the body 20. The receptacle is therefore more hygienic as waste material is within the receptacle body 20, rather than on the outside of the receptacle body 20 as would occur if the lid was positioned outside the body 20.

An alternative option for support means is also shown in FIG. 3. In this option, the support means 60 is a pedestal arrangement which includes of a base 65 adapted to sit on the floor or other such surface. The base will preferably be of any suitable heavy material to provide a low centre of gravity and thus provide stability. The base 65 may sit flat on the floor, or may include a plurality of feet (not shown). The feet would be in a configuration and number to maximise the stability of the receptacle 1.

An elongate extension 66 is engageable with the base 65 at one end and engageable with a projection 62 at the other. The projection is attached to a rail 63 as described in FIGS. 1 and 2. The receptacle 1 fits inside the rail 63 and the rail 63 abuts the concave side 26 of the external support flange 24 thus holding receptacle 1 in position also as described in FIGS. 1 and 2. As will be appreciated, the elongate extension 66 would be of a sufficient length to allow the length of the receptacle to be supported above the base 65 when the flange is supported by the rail 63. The elongate extension 66 may also be of sufficient height to leave space between the base 21 of the body 20, and the top of the base 65 of the supporting means 60 to allow easy cleaning of the base 65 and the area around this.

The elongate extension 66 can be of any shape or size as required, including for aesthetic requirements, as would be appreciated by persons skilled in the art. In FIG. 3, the elongate extension 66 is shown as a concave sheet which mirrors the shape of the body 20. The elongate extension 66 may preferably be of another configuration, for example a round pole (see also FIG. 6) or a substantially rectangular shape.

Figure 4:
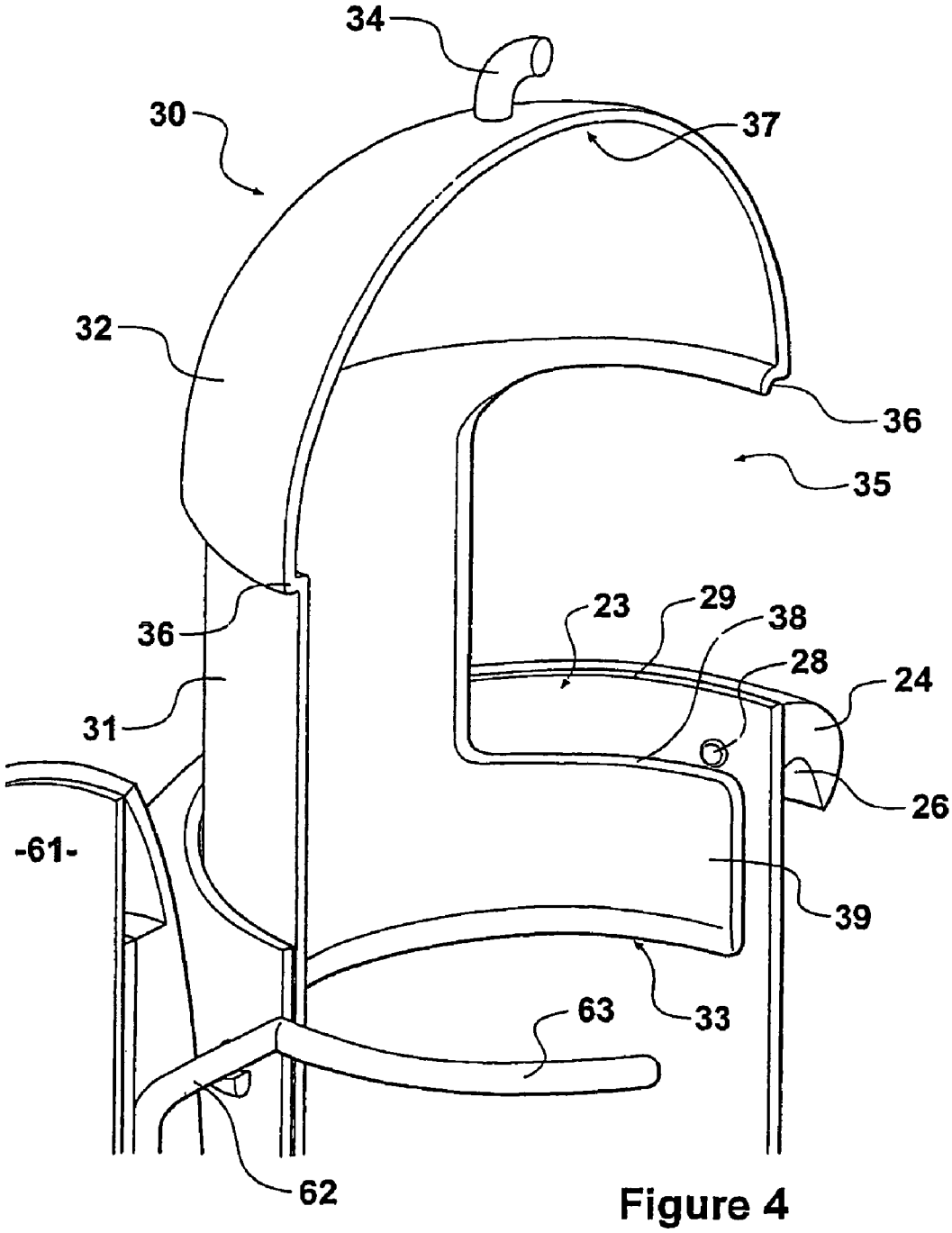
FIG. 4: shows an exploded and rotated cross section through the axis X-X of the embodiment shown in FIG. 1.

FIG. 4 shows detail of the receptacle 1 with the lid 30 in the open position. As can be seen, the body 20 may also include a protrusion 28 which acts as a retention mechanism that prevents the lid 30 from being completely removed from the body 20 when moved into the open position.

In a preferred embodiment of the invention, the protrusion 28 is positioned at the upper portion of the body side 22. When the lid 30 is initially fitted into body 20, the lid 30 is forced into position within the body 20 by pressure exerted in the direction of base 21 of the body 20. This forces the lid side 31 to ride over the protrusion 28. Once the lid 30 is fitted into the body 20, the protrusion 28 sits within the aperture 35 as shown in FIG. 4. The bottom edge 38 of the aperture 35 catches on the protrusion 28, preventing the lid 30 from being easily removed from the body 20. The sides of aperture 35 prevent excess rotational movement.

As an alternative, the lid wall 31 beneath the aperture 35 (shown at 39 on FIG. 4) could include a channel (not shown) adapted to receive the protrusion 28. The channel would increase the ease by which the lid 30 could be inserted into body 20 over the protrusion 28. As would be apparent to the skilled person, the channel may include a barrier to prevent the lid 30 from simply sliding out of the body 20 via the channel. Alternatively the lid 30 could simply be rotated within the body 30 to take protrusion 28 out of line with the channel.

The rotation of the lid 30 also allows the position of the aperture 35 to be placed at an angle accessible to the position of the user. This is an additional distinct advantage of the telescopic nature of the receptacle lid 30. In addition to advantages from a minimisation of corners and crevices resulting in hygiene advantages, the ability to rotate the lid thus allowing the user to adjust the position of the aperture 35 is a distinct advantage over the use of hinged or otherwise fixed lids. This allows greater utilisation of space while allowing ergonomic access to the aperture 35 by the user from either a seated or standing position. The rotation also ensures that the aperture 35 is easily accessible to the user when the lid 30 is in the open position, allowing for easy access of the waste into the receptacle 1, while also ensuring that sight into the receptacle 1 is minimised. As will be readily apparent, the ability to rotate the lid 30 to at least a limited extent will be restricted to those receptacles that are cylindrical or otherwise circular in shape such as shown in the preferred embodiments of the Figures. This at least partial rotatability is why the cylindrical option is a very much preferred option. It may also be an option however, to have top portion of the lid 30 rotatable while the lower sides of the lid are not. This may be an option in multisided receptacles but it is not preferred as, again, it will increase the amount of crevices in the device and will also add to cost. It is also a preferred option to have the lid 30 being rotatable only when in open position.

Also as seen in FIG. 4, the lid 30 may include a circumferential lip 36 (also indicated in FIG. 2) which extends from the lid 30 and is positioned above the aperture 35. When the lid 30 is in a closed position, the lip 36 abuts the body sides 22 to prevent the lid 30 from moving too far into the body 20. The lip 36 is preferably shaped to readily fit with the shape of flange 24. The lip 36 is positioned high enough so that the aperture 35 is inaccessible when the lid 30 is in the closed position. This ensures that no waste material can escape, and that the receptacle 1 is sealed when not in use to limit the extent of odours being released. The optional presence of lip 36 can further increase the hygienic advantages of the receptacle 1. As will be appreciated, the lip 36 need not be completely circumferential. Other options to prevent lid 30 movement into the body 20 may also be used.

The lid 30 may also include on the inside surface, for example at 37 in FIG. 4, a hook or other such fastening means to allow the attachment of freshness products. For example antibacterial scented quills which would allow a fresh scent to escape when the lid 30 is moved into the open position. Previously, such options were only able to be readily provided by placing freshness products in the base of the receptacle. This had the disadvantage that waste products would cover the freshness products limiting and interfering with the scent over time. The present invention allows the option of overcoming this distinct disadvantage.

Figure 6:
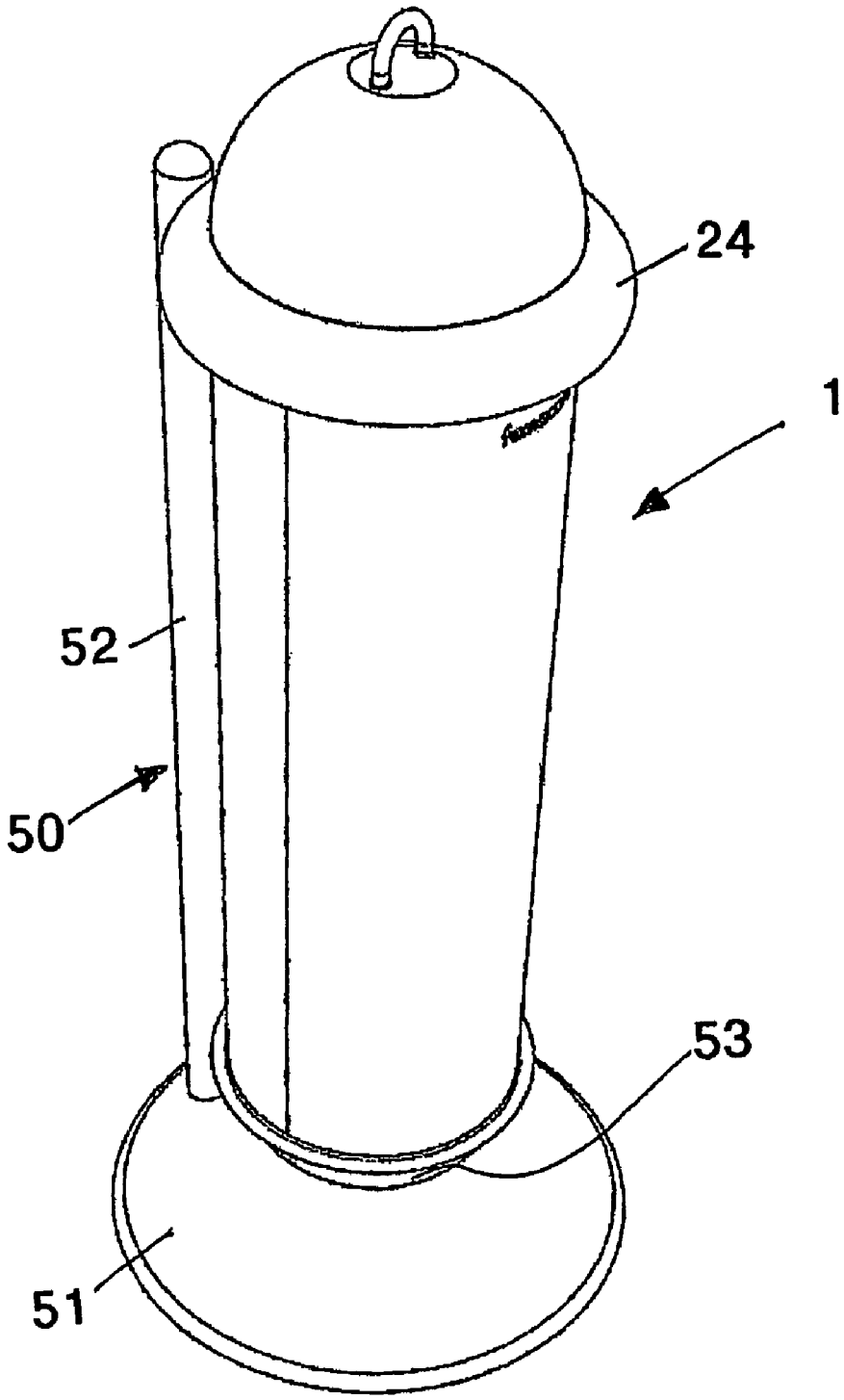
FIG. 6.

FIG. 6 shows the receptacle 1 in a closed position held by an alternative form of support means 50. The support means is in the form of a pedestal having a wide and preferably weighted base 51 together with a stand 52. The stand 52 has a loop (obscured in FIG. 6), that could be a partial loop or a complete loop, which is adapted to fit under the flange 24 and hold the receptacle 1 in place. The base 51 includes a recess (obscured in FIG. 6) that is adapted to receive the domed shaped bottom 53 (partially obscured in FIG. 6) of receptacle 1. This support means 50 is therefore a stable and secure support option for the receptacle 1 in its preferred form having a domed bottom. Such support means also forming part of the invention to which the application is directed.

With reference to FIG. 5, the concave nature of the underside 26 of the flange 24 can assist in ease of carrying the bin. The flange 24 may also be adapted for use in storing the receptacles, or in stowing them for transport (not shown). A series of racks may be provided, for example in a truck or in a stand alone unit, which may allow the receptacles to be suspended from the racks via the flange 24. The racks may be substantially horizontal, and in contact with opposite sides of the receptacle via the flange. Alternatively, individual support means may be provided, which are adapted to receive the receptacles in a similar manner to the support means described above. Other options for stowage may be used as would be known in the art. The stowage options may take advantage of the locking mechanism 27 if required, for example in truck transportation where the loads in the truck may be required to be kept secure.

While the above description describes preferred support means, alternatives may also be used. For example, the supporting means may be a claw shaped support which extends from the wall in which the receptacle may fit. As will be apparent the mounting surface to which the receptacle is attached is preferably a vertical wall. However the apparatus could be attached to surfaces having curved or other angular aspects if needed. The combination of receptacle plus means support capable of being a kit. Alternatively, the receptacle may fit into an opening in a bench top so that the flange 24 abuts the bench top surface around the opening, thereby holding the upper portion of the receptacle 1 in an accessible position above the bench top. The lower portion of the receptacle 1 could be obscured below the bench top, for example by means of a cupboard or wall. Such alternative support means which exploit flange 24 and/or the shape of the receptacle 1 would be appreciated by persons skilled in the art.

It would also be appreciated, that while less preferred, the base 21 of the receptacle 1 may be substantially flat, allowing the receptacle 1 to sit independently of a support means on the floor or other such surface. The domed shape of the base as shown in the Figures is however, preferred.

The receptacle 1 may also be made of any suitable material and by manufacturing methods that would be well known in the art. When the receptacle is made of plastics material, these manufacturing methods would include blow or injection moulding techniques for example.

Where the foregoing description there has been made reference to specific components or integers of the invention having known equivalents, then such equivalents are herein incorporated as if individually set forth.

Although this invention has been described by way of example only and with reference to possible embodiments thereof, it is to be understood that modifications or improvements may be made without departing from the scope or spirit of the invention as defined in the attached claims.

The invention claimed is:

1. A receptacle including a body and a lid the body comprising a base, at least one side and an open top; and the lid comprising at least one side, a top, an open base and an aperture in the side through which material can be deposited into the receptacle; wherein the material when placed into the receptacle via the aperture falls through the open base of the lid and into the body, wherein the at least one side of the lid is adapted to be received within the body and is reversibly and telescopically movable between an open and closed position such that when the lid is in the closed position the aperture is covered by said at least one side and when the lid is in the open position, the aperture is exposed, wherein excess rotation of the lid is restricted and wherein the lid is lifted to expose the aperture.

2. The receptacle according to claim 1 wherein the body and lid are cylindrical and the lid is also at least partially rotatable within the body.

3. The receptacle according to claim 1 wherein the body and lid have more than one side, the lid sides being reciprocally movable relative to the body sides.

4. The receptacle according to claim 1 wherein the lid and the body interact to form a substantially airtight seal.

5. The receptacle according to claim 1 including an opening means to assist a user in moving the lid from the closed to the open position.

6. The receptacle according to claim 5 wherein the opening means is a handle attached to the lid.

7. The receptacle according to claim 1 wherein the body includes a retention mechanism which prevents the lid from being readily removed from within the body.

8. The receptacle according to claim 7 wherein the lid includes a lip which prevents the top of the lid from moving past the open top of the body.

9. The receptacle according to claim 1 wherein the body further includes an external support flange.

10. The receptacle according to claim 1 wherein the base of the body includes a domed or flat external surface.

11. The receptacle according to claim 10 wherein the base of the body is flat and is adapted to support the receptacle in a free standing manner.

12. The receptacle according to claim 1 wherein the lid includes fastening means attached to the inside of the lid wall, the fastening means being adapted to allow attachment of freshness products inside the receptacle.

13. The receptacle according to claim 1 wherein the lid includes a lip situated above the aperture, the lip being adapted, when the receptacle is in the closed position, to abut the top of the body wall and to allow the aperture to be covered by the body wall.

14. The receptacle according to claim 13 wherein the lip is circumferential about the lid side.

15. The receptacle according to claim 13 wherein the lip is not circumferential but extends sufficiently about the lid side to extend at least the length of the aperture.

16. A receptacle according to claim 1 together with a support means, wherein the receptacle body further includes an external support flange, and the support means is adapted to interact with the external support flange to removably attach the receptacle to the support means.

17. The receptacle according to claim 16 wherein the support means is also attachable to a mounting surface.

18. The receptacle according to claim 17 wherein the mounting surface is a wall.

19. The receptacle according to claim 16 wherein the support means is a pedestal.

20. A cylindrical receptacle including a body and a lid the body comprising a base, a cylindrical side, an open top and an external flange for attachment to a support device;

the lid is comprising a cylindrical side, a top, an open base and an aperture in the side through which material can be deposited into the receptacle and an opening means; wherein the material when placed into the receptacle via the aperture falls through the open base of the lid and into the body, wherein the cylindrical side of the lid is adapted to be received within the cylindrical side of the body and is at least partially rotatably movable within the body and is reversibly and telescopically movable within the body between an open and closed position such that when the lid is in the closed position the aperture is covered by said cylindrical body side and when the lid is in the open position, the aperture is exposed; the receptacle also including a retention mechanism which prevents the lid being readily removed from the body on rotational or reversible movement, wherein excess rotation of the lid is restricted and wherein the lid is lifted to expose the aperture.

21. The cylindrical receptacle according to claim 20 wherein the lid is rotatable when the receptacle is in an open position.

* * * * *